US011709004B2

(12) United States Patent
Goel et al.

(10) Patent No.: US 11,709,004 B2
(45) Date of Patent: Jul. 25, 2023

(54) METHOD AND A SYSTEM FOR PREVENTING A FREEZE EVENT USING REFRIGERANT TEMPERATURE

(71) Applicant: Lennox Industries Inc., Richardson, TX (US)

(72) Inventors: Rakesh Goel, Irving, TX (US); Siddarth Rajan, Addison, TX (US)

(73) Assignee: Lennox Industries Inc., Richardson, TX (US)

( * ) Notice: Subject to any disclaimer, the term of this patent is extended or adjusted under 35 U.S.C. 154(b) by 175 days.

(21) Appl. No.: 17/123,476

(22) Filed: Dec. 16, 2020

(65) Prior Publication Data

US 2022/0186997 A1 Jun. 16, 2022

(51) Int. Cl.

*F25B 47/02* (2006.01)
*F25B 49/02* (2006.01)
*F25B 39/02* (2006.01)

(52) U.S. Cl.

CPC ..... *F25B 47/02* (2013.01); *F25B 39/02* (2013.01); *F25B 49/022* (2013.01); *F25B 2339/02* (2013.01); *F25B 2347/02* (2013.01); *F25B 2600/0253* (2013.01); *F25B 2700/21174* (2013.01)

(58) Field of Classification Search

CPC ..... F25B 47/00; F25B 47/006; F25B 47/02; F25B 2347/02; F25B 2600/01; F25B 2600/02; F25B 2600/0251; F25B 2600/0253; F25B 2600/23

See application file for complete search history.

(56) References Cited

U.S. PATENT DOCUMENTS 4,768,348 A 9/1988 Noguchi
5,191,768 A 3/1993 Fujii
5,267,450 A 12/1993 Takegawa et al.
5,553,462 A * 9/1996 Taylor ..... F25D 21/002 62/155
5,970,726 A 10/1999 Derosier et al.

(Continued)

FOREIGN PATENT DOCUMENTS

EP 0451566 A2 10/1991
EP 0494785 A1 7/1992

(Continued)

*Primary Examiner* — Jerry-Daryl Fletcher
*Assistant Examiner* — Daniel C Comings
(74) *Attorney, Agent, or Firm* — Bradley Arant Boult Cummings

(57) ABSTRACT

A method includes measuring a saturated suction temperature, receiving actual temperature value reflective of the measured saturated suction temperature, and determining whether the actual temperature value is less than a first pre-determined minimum threshold temperature value. If the actual temperature value is less than the first pre-determined minimum threshold temperature value, initiating a timer to operate for a pre-determined time interval. Determining whether the actual temperature value is less than a second pre-determined minimum threshold temperature value and if the actual temperature value is less the second pre-determined minimum threshold temperature value, initiating the timer to operate for a modified time interval. If the timer has expired, the operation of the compressor is modified.

19 Claims, 3 Drawing Sheets

(56) References Cited

U.S. PATENT DOCUMENTS

| | | | | |
|---|---|---|---|---|
| 6,026,650 | A | 2/2000 | Beaverson et al. | |
| 6,119,472 | A * | 9/2000 | Ross | A23G 9/225 62/342 |
| 6,460,359 | B1 | 10/2002 | Lauwers | |
| 8,739,563 | B2 | 6/2014 | Coussey et al. | |
| 9,207,001 | B1 | 12/2015 | Roth et al. | |
| 2006/0042296 | A1 | 3/2006 | Ludwig et al. | |
| 2010/0319372 | A1 | 12/2010 | Lifson | |
| 2012/0266615 | A1 | 10/2012 | Coussey et al. | |
| 2013/0014521 | A1 | 1/2013 | Lukasse et al. | |
| 2014/0345307 | A1 | 11/2014 | Bagley et al. | |
| 2015/0068231 | A1* | 3/2015 | Rite | F25B 49/02 62/204 |
| 2015/0330650 | A1 | 11/2015 | Abiprojo et al. | |
| 2016/0178261 | A1 | 6/2016 | Kimura et al. | |
| 2017/0276422 | A1* | 9/2017 | Chamoun | F25B 30/02 |
| 2018/0274832 | A1 | 9/2018 | De et al. | |
| 2018/0340719 | A1 | 11/2018 | Rona et al. | |
| 2019/0128569 | A1 | 5/2019 | Tada et al. | |
| 2019/0226706 | A1 | 7/2019 | Liu et al. | |
| 2019/0277549 | A1 | 9/2019 | Nishiyama et al. | |
| 2020/0240679 | A1 | 7/2020 | Morimoto | |
| 2020/0355418 | A1* | 11/2020 | Najafifard | A47F 3/0478 |

FOREIGN PATENT DOCUMENTS

| | | | |
|---|---|---|---|
| JP | 2009092268 | A | 4/2009 |
| JP | 2009236332 | A | 10/2009 |
| JP | 2019020039 | A | 2/2019 |
| RU | 2459153 | C2 | 8/2012 |
| WO | WO-0070280 | A1 | 11/2000 |
| WO | WO-2014170982 | A1 | 10/2014 |

* cited by examiner

METHOD AND A SYSTEM FOR PREVENTING A FREEZE EVENT USING REFRIGERANT TEMPERATURE

BACKGROUND

Technical Field

The present disclosure relates generally to heating, ventilation, and air conditioning (HVAC) systems and more particularly, but not by way of limitation, to methods and systems for preventing a freeze event using refrigerant temperature.

History of Related Art

This section provides background information to facilitate a better understanding of the various aspects of the disclosure. It should be understood that the statements in this section of this document are to be read in this light, and not as admissions of prior art.

HVAC systems are used to regulate environmental conditions within an enclosed space. Typically, HVAC systems have a circulation fan that pulls air from the enclosed space through ducts and pushes the air back into the enclosed space through additional ducts after conditioning the air (e.g., heating, cooling, humidifying, or dehumidifying the air). To direct operation of the circulation fan and other components, HVAC systems include a controller. In addition to directing operation of the HVAC system, the controller may be used to monitor various components, (i.e. equipment) of the HVAC system to determine if the components are functioning properly.

A more complete understanding of embodiments of the present invention may be obtained by reference to the following Detailed Description when taken in conjunction with the accompanying Drawings wherein.

DETAILED DESCRIPTION OF ILLUSTRATIVE EMBODIMENTS

Figure 1:
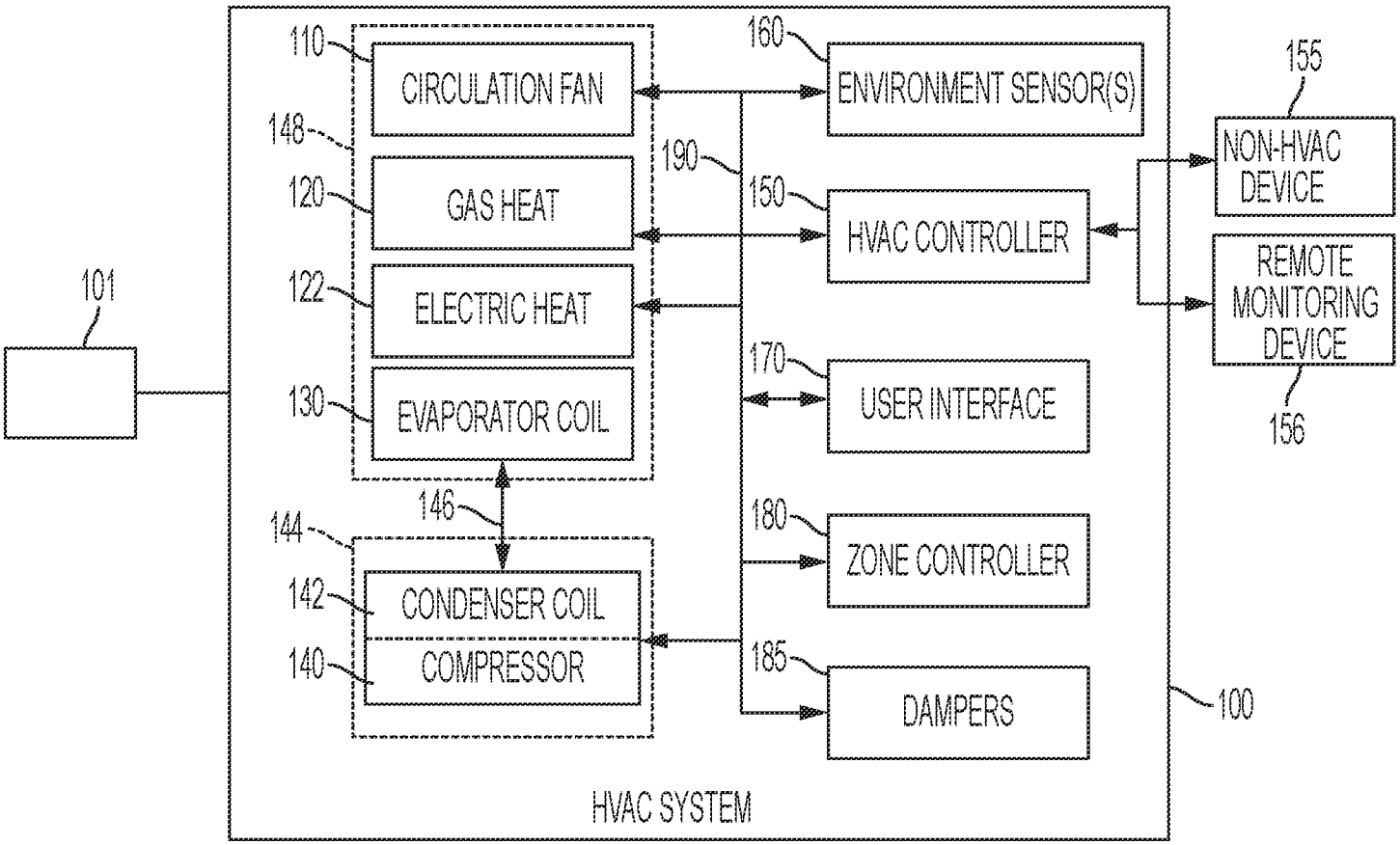
FIG. 1 is a block diagram of an exemplary HVAC system.

Various embodiments of the present invention will now be described more fully with reference to the accompanying drawings. The invention may, however, be embodied in many different forms and should not be construed as limited to the embodiments set forth herein.

HVAC systems are frequently utilized to adjust both temperature of conditioned air as well as relative humidity of the conditioned air. A cooling capacity of an HVAC system is a combination of the HVAC system's sensible cooling capacity and latent cooling capacity. Sensible cooling capacity refers to an ability of the HVAC system to remove sensible heat from conditioned air. Latent cooling capacity refers to an ability of the HVAC system to remove latent heat from conditioned air. In a typical embodiment, sensible cooling capacity and latent cooling capacity vary with environmental conditions. Sensible heat refers to heat that, when added to or removed from the conditioned air, results in a temperature change of the conditioned air. Latent heat refers to heat that, when added to or removed from the conditioned air, results in a phase change of, for example, water within the conditioned air. Sensible-to-total ratio ("SIT ratio") is a ratio of sensible heat to total heat (sensible heat+latent heat). The lower the S/T ratio, the higher the latent cooling capacity of the HVAC system for given environmental conditions. In a typical embodiment, the S/T ratio is negative in the case of heating.

Sensible cooling load refers to an amount of heat that must be removed from the enclosed space to accomplish a desired temperature change of the air within the enclosed space. The sensible cooling load is reflected by a temperature within the enclosed space as read on a dry-bulb thermometer. Latent cooling load refers to an amount of heat that must be removed from the enclosed space to accomplish a desired change in humidity of the air within the enclosed space. The latent cooling load is reflected by a temperature within the enclosed space as read on a wet-bulb thermometer. Setpoint or temperature setpoint refers to a target temperature setting of the HVAC system as set by a user or automatically based on a pre-defined schedule.

During operation of an HVAC system, evaporator coils may suffer loss in performance as a result of ice forming on an evaporator itself. Ice may form on an exterior of the evaporator due to a variety of conditions. Common causes of ice formation include, for example, loss of refrigerant charge, low ambient temperatures, dirty evaporator coils, uneven air flow distribution over the evaporator, low load requirement, indoor blower fan degradation, low refrigerant saturation suction temperature, and reduced air flow over the evaporator which may occur due to a dirty or blocked air filter. These conditions may cause surface temperature of the evaporator coil, either across the entire evaporator or localized to particular regions, to fall. If the temperature of air passing over the evaporator drops below a dew point, any water vapor that may be present in the air will begin to condense onto the evaporator.

An evaporator experiencing a freeze risk and ultimately experiencing ice buildup on the surface of the evaporator coil will have diminished performance. The ice buildup may increase heat resistance of the evaporator and slow heat transfer between the refrigerant and air. Ice buildup may also reduce a rate of air flow that passes over a surface of the evaporator, further reducing cooling capacity. The reduced heat transfer between the evaporator and the air may exacerbate the temperature drop of the evaporator coil, leading to further ice buildup and increasingly poor performance of the HVAC system. Not only is reduced cooling to a conditioned space an inconvenience, it may cause reliability issues and decrease the life of the HVAC system. For example, reduction in the evaporator's heat transfer rate as a result of the ice buildup, leads to lower refrigerant suction pressure, which may cause reliability issues for the HVAC system's compressor.

Some conventional systems may use a freeze stat installed proximate the evaporator to protect against the HVAC system from operating once the evaporator has begun to experience a freeze event such as, for example, ice or frost buildup. Typically, the freeze stat may have a first setpoint for a temperature close to the freezing point. When the freeze stat detects that the temperature of the evaporator coil has reached the first setpoint, the HVAC system will deactivate the compressor. The compressor will not resume operation until the freeze stat detects that the temperature of the evaporator coil has increased to a second setpoint indicating that there is no remaining ice or frost buildup on the evaporator.

Certain embodiments of the present disclosure may have advantages over conventional systems using the freeze stat.

For example, certain embodiments reduce material cost and operational cost because the freeze stat and associated components can be omitted from the HVAC system. Another advantage of certain embodiments is that the HVAC system can detect the freeze event (e.g., ice or frost buildup) that occurs anywhere on the evaporator. This is an advantage compared to the conventional freeze stat because the conventional freeze stat may only detect freezing of a discrete portion of the evaporator coil (which might not necessarily be the portion of the evaporator coil that is experiencing the risk of freezing). Additionally, certain embodiments improve user comfort within the conditioned space. For example, rather than employing the freeze stat that causes the compressor to completely power off when detecting the freeze event, embodiments of the present disclosure may take actions to mitigate the freeze event in order to reduce a likelihood of having to completely power off the compressor. It is understood that certain embodiments may include other advantages and that the advantages described are merely examples. Certain embodiments may include all, some, or none of the above-described advantages.

FIG. 1 illustrates an HVAC system 100. In a typical embodiment, the HVAC system 100 is a networked HVAC system that is configured to condition air via, for example, heating, cooling, humidifying, or dehumidifying air within an enclosed space 101. In a typical embodiment, the enclosed space 101 is, for example, a house, an office building, a warehouse, and the like. Thus, the HVAC system 100 can be a residential system or a commercial system such as, for example, a roof top system. For exemplary illustration, the HVAC system 100 as illustrated in FIG. 1 includes various components; however, in other embodiments, the HVAC system 100 may include additional components that are not illustrated but typically included within HVAC systems.

The HVAC system 100 includes a variable-speed circulation fan 110, a gas heat 120, electric heat 122 typically associated with the variable-speed circulation fan 110, and a refrigerant evaporator coil 130, also typically associated with the variable-speed circulation fan 110. The variable-speed circulation fan 110, the gas heat 120, the electric heat 122, and the refrigerant evaporator coil 130 are collectively referred to as an "indoor unit" 148. In a typical embodiment, the indoor unit 148 is located within, or in close proximity to, the enclosed space 101. The HVAC system 100 also includes a variable-speed compressor 140 and an associated condenser coil 142, which are typically referred to as an "outdoor unit" 144. In various embodiments, the outdoor unit 144 is, for example, a rooftop unit or a ground-level unit. The variable-speed compressor 140 and the associated condenser coil 142 are connected to an associated evaporator coil 130 by a refrigerant line 146. In a typical embodiment, the variable-speed compressor 140 is, for example, a single-stage compressor, a multi-stage compressor, a single-speed compressor, or a variable-speed compressor. The variable-speed circulation fan 110, sometimes referred to as a blower, is configured to operate at different capacities (i.e., variable motor speeds) to circulate air through the HVAC system 100, whereby the circulated air is conditioned and supplied to the enclosed space 101.

Still referring to FIG. 1, the HVAC system 100 includes an HVAC controller 150 that is configured to control operation of the various components of the HVAC system 100 such as, for example, the variable-speed circulation fan 110, the gas heat 120, the electric heat 122, and the variable-speed compressor 140 to regulate the environment of the enclosed space 101. In some embodiments, the HVAC system 100 can be a zoned system. In such embodiments, the HVAC system 100 includes a zone controller 180, dampers 185, and a plurality of environment sensors 160. In a typical embodiment, the HVAC controller 150 cooperates with the zone controller 180 and the dampers 185 to regulate the environment of the enclosed space 101.

The HVAC controller 150 may be an integrated controller or a distributed controller that directs operation of the HVAC system 100. In a typical embodiment, the HVAC controller 150 includes an interface to receive, for example, thermostat calls, temperature setpoints, blower control signals, environmental conditions, and operating mode status for various zones of the HVAC system 100. For example, in a typical embodiment, the environmental conditions may include indoor temperature and relative humidity of the enclosed space 101. In a typical embodiment, the HVAC controller 150 also includes a processor and a memory to direct operation of the HVAC system 100 including, for example, a speed of the variable-speed circulation fan 110.

Still referring to FIG. 1, in some embodiments, the plurality of environment sensors 160 are associated with the HVAC controller 150 and also optionally associated with a user interface 170. The plurality of environment sensors 160 provide environmental information within a zone or zones of the enclosed space 101 such as, for example, temperature and humidity of the enclosed space 101 to the HVAC controller 150. The plurality of environment sensors 160 may also send the environmental information to a display of the user interface 170. In some embodiments, the user interface 170 provides additional functions such as, for example, operational, diagnostic, status message display, and a visual interface that allows at least one of an installer, a user, a support entity, and a service provider to perform actions with respect to the HVAC system 100. In some embodiments, the user interface 170 is, for example, a thermostat of the HVAC system 100. In other embodiments, the user interface 170 is associated with at least one sensor of the plurality of environment sensors 160 to determine the environmental condition information and communicate that information to the user. The user interface 170 may also include a display, buttons, a microphone, a speaker, or other components to communicate with the user. Additionally, the user interface 170 may include a processor and memory that is configured to receive user-determined parameters such as, for example, a relative humidity of the enclosed space 101, and calculate operational parameters of the HVAC system 100 as disclosed herein.

In a typical embodiment, the HVAC system 100 is configured to communicate with a plurality of devices such as, for example, a monitoring device 156, a communication device 155, and the like. In a typical embodiment, the monitoring device 156 is not part of the HVAC system. For example, the monitoring device 156 is a server or computer of a third party such as, for example, a manufacturer, a support entity, a service provider, and the like. In other embodiments, the monitoring device 156 is located at an office of, for example, the manufacturer, the support entity, the service provider, and the like.

In a typical embodiment, the communication device 155 is a non-HVAC device having a primary function that is not associated with HVAC systems. For example, non-HVAC devices include mobile-computing devices that are configured to interact with the HVAC system 100 to monitor and modify at least some of the operating parameters of the HVAC system 100. Mobile computing devices may be, for example, a personal computer (e.g., desktop or laptop), a tablet computer, a mobile device (e.g., smart phone), and the like. In a typical embodiment, the communication device 155 includes at least one processor, memory and a user interface, such as a display. One skilled in the art will also understand that the communication device 155 disclosed herein includes other components that are typically included in such devices including, for example, a power supply, a communications interface, and the like.

The zone controller 180 is configured to manage movement of conditioned air to designated zones of the enclosed space 101. Each of the designated zones include at least one conditioning or demand unit such as, for example, the gas heat 120 and at least one user interface 170 such as, for example, the thermostat. The zone-controlled HVAC system 100 allows the user to independently control the temperature in the designated zones. In a typical embodiment, the zone controller 180 operates electronic dampers 185 to control air flow to the zones of the enclosed space 101.

In some embodiments, a data bus 190, which in the illustrated embodiment is a serial bus, couples various components of the HVAC system 100 together such that data is communicated therebetween. In a typical embodiment, the data bus 190 may include, for example, any combination of hardware, software embedded in a computer readable medium, or encoded logic incorporated in hardware or otherwise stored (e.g., firmware) to couple components of the HVAC system 100 to each other. As an example and not by way of limitation, the data bus 190 may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. In various embodiments, the data bus 190 may include any number, type, or configuration of data buses 190, where appropriate. In particular embodiments, one or more data buses 190 (which may each include an address bus and a data bus) may couple the HVAC controller 150 to other components of the HVAC system 100. In other embodiments, connections between various components of the HVAC system 100 are wired. For example, conventional cable and contacts may be used to couple the HVAC controller 150 to the various components. In some embodiments, a wireless connection is employed to provide at least some of the connections between components of the HVAC system such as, for example, a connection between the HVAC controller 150 and the variable-speed circulation fan 110 or the plurality of environment sensors 160.

Figure 2:
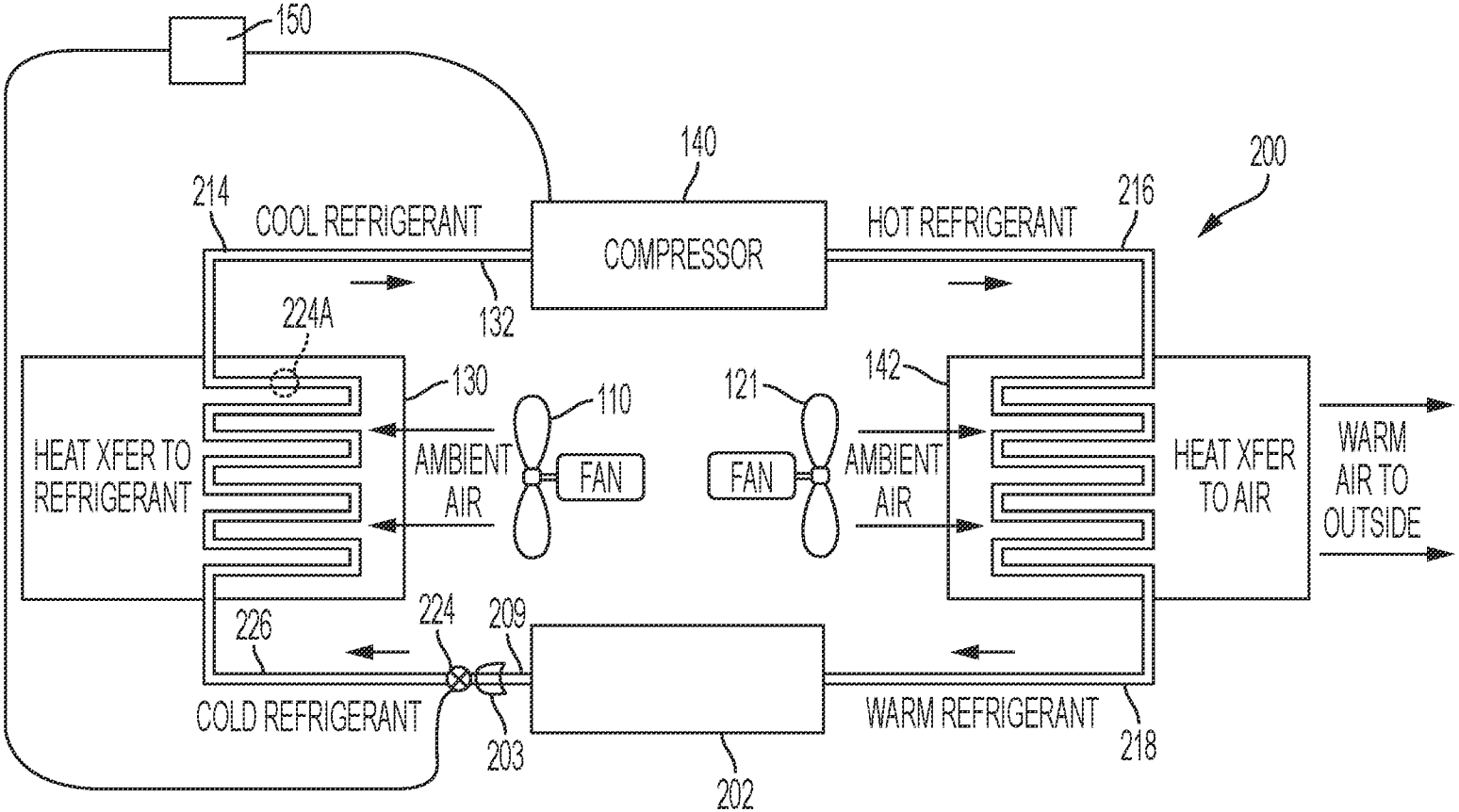
FIG. 2 is a schematic diagram of the HVAC system of FIG. 1 according to an exemplary embodiment.

FIG. 2 is a schematic diagram of the HVAC system of FIG. 1 according to an exemplary embodiment. For illustrative purposes. FIG. 2 will be described herein relative to FIG. 1. The HVAC system 200 includes the refrigerant evaporator coil 130, the condenser coil 142, the variable-speed compressor 140, a metering device 202, and a distributor 203. In a typical embodiment, the metering device 202 is, for example, a thermostatic expansion valve or a throttling valve. The refrigerant evaporator coil 130 is fluidly coupled to the variable-speed compressor 140 via a suction line 214. The variable-speed compressor 140 is fluidly coupled to the condenser coil 142 via a discharge line 216. The condenser coil 142 is fluidly coupled to the metering device 202 via a liquid line 218. The distributor 203 is fluidly coupled to the metering device 202 via an evaporator intake line 209. The distributor 203 directs refrigerant to the refrigerant evaporator coil 130 via an evaporator circuit line 226.

Still referring to FIG. 2, during operation, low-pressure, low-temperature refrigerant is circulated through the refrigerant evaporator coil 130. The refrigerant is initially in a liquid/vapor state. In a typical embodiment, the refrigerant is, for example, R-22, R-134a, R-410A, R-744, or any other suitable type of refrigerant as dictated by design requirements. Air from within the enclosed space 101, which is typically warmer than the refrigerant, is circulated around the refrigerant evaporator coil 130 by the variable-speed circulation fan 110. In a typical embodiment, the refrigerant begins to boil after absorbing heat from the air and changes state to a low-pressure, low-temperature, super-heated vapor refrigerant. Saturated vapor, saturated liquid, and saturated fluid refer to a thermodynamic state where a liquid and its vapor exist in approximate equilibrium with each other. Super-heated fluid and super-heated vapor refer to a thermodynamic state where a vapor is heated above a saturation temperature of the vapor. Sub-cooled fluid and sub-cooled liquid refers to a thermodynamic state where a liquid is cooled below the saturation temperature of the liquid.

The low-pressure, low-temperature, super-heated vapor refrigerant is introduced into the compressor 140 via the suction line 214. In a typical embodiment, the compressor 140 increases the pressure of the low-pressure, low-temperature, super-heated vapor refrigerant and, by operation of the ideal gas law, also increases the temperature of the low-pressure, low-temperature, super-heated vapor refrigerant to form a high-pressure, high-temperature, superheated vapor refrigerant. The high-pressure, high-temperature, superheated vapor refrigerant leaves the compressor 140 via the discharge line 216 and enters the condenser coil 142.

Still referring to FIG. 2, outside air is circulated around the condenser coil 142 by a condenser fan 121. The outside air is typically cooler than the high-pressure, high-temperature, superheated vapor refrigerant present in the condenser coil 142. Thus, heat is transferred from the high-pressure, high-temperature, superheated vapor refrigerant to the outside air. Removal of heat from the high-pressure, high-temperature, superheated vapor refrigerant causes the high-pressure, high-temperature, superheated vapor refrigerant to condense and change from a vapor state to a high-pressure, high-temperature, sub-cooled liquid state. The high-pressure, high-temperature, sub-cooled liquid refrigerant leaves the condenser coil 142 via the liquid line 218 and enters the metering device 202.

In the metering device 202, the pressure of the high-pressure, high-temperature, sub-cooled liquid refrigerant is abruptly reduced. In various embodiments where the metering device 202 is, for example, a thermostatic expansion valve, the metering device 202 reduces the pressure of the high-pressure, high-temperature, sub-cooled liquid refrigerant by regulating an amount of refrigerant that travels to the evaporator coil 130. Abrupt reduction of the pressure of the high-pressure, high-temperature, sub-cooled liquid refrigerant causes sudden, rapid, evaporation of a portion of the high-pressure, high-temperature, sub-cooled liquid refrigerant, commonly known as "flash evaporation." The flash evaporation lowers the temperature of the resulting liquid/vapor refrigerant mixture to a temperature lower than a temperature of the air in the enclosed space 101. The liquid/vapor refrigerant mixture leaves the metering device 202 and enters the distributor 203 via the evaporator intake line 209. The distributor 203 directs refrigerant to the refrigerant evaporator coil 130 via the evaporator circuit line 226.

Some conventional systems may use the freeze stat installed proximate the evaporator to protect against the HVAC system continually operating once the evaporator has begun to experience the freeze event. Rather than employing the freeze stat that causes the compressor to completely power off when detecting the freeze event, embodiments of the present disclosure utilize at least one temperature sensor and temperature values obtained from the at least one temperature sensor to control operation of the compressor upon detecting the freeze event to mitigate the risk of ice or frost buildup.

According to an exemplary embodiment, a temperature sensor 224 is disposed proximate the distributor 203 on the evaporator circuit line 226. In various embodiments, the temperature sensor 224 may be, for example, a thermocouple, a thermometer, a thermostat, or any other appropriate temperature sensor. The temperature sensor 224 is electrically coupled to the HVAC controller 150 and measures a refrigerant temperature prior to the refrigerant entering the evaporator coil 130 (also known as the "saturated suction temperature"). In other embodiments, however, the temperature sensor 224 may be disposed at various locations within the HVAC system 200 such as, for example, on an exterior surface of the evaporator coil 130 (illustrated by dotted circle 224A) thereby using an evaporator coil 130 surface temperature as a proxy measurement for the saturated suction temperature. In a typical embodiment, only one temperature sensor 224 is utilized to measure the saturated suction temperature; however, in other embodiments, any number of temperature sensors can be utilized as dictated by design requirements. In various embodiments, the temperature sensor 224, is electrically coupled to the HVAC controller 150 via, for example, a wired or a wireless connection. For illustrative purposes, the temperature sensor 224 is described to measure the saturated suction temperature; however, in alternate embodiments, the saturated suction temperature can be calculated using a refrigerant suction pressure which can be measured using a pressure transducer. For example, the saturated suction temperature can be calculated from the refrigerant suction pressure utilizing the table below:

| SUCTION PRESSURE (SP) | SATURATED SUCTION TEMPERATURE (SST) | TIMER SETTINGS (S) |
|---|---|---|
| 101 | 32 | 180 |
| 78 | 20 | 44 |
| 62 | 10 | 5 |
| 48 | 0 | 0 |

Still referring to FIG. 2, during operation, the HVAC controller 150 receives an actual temperature value reflective of the measured saturated suction temperature by the temperature sensor 224. If the HVAC controller 150 determines that the saturated suction temperature is indicative of the freeze event (e.g., ice or frost buildup), the HVAC controller 150 modifies operation of the compressor 140 to mitigate the risk of ice or frost buildup. In various embodiments, conditions that could be indicative of the freeze event include, for example, the saturated suction temperature measured by the temperature sensor 124 to be below a first pre-determined minimum threshold temperature value. In a typical embodiment, the first pre-determined minimum threshold temperature value may be, for example, 32° F. In a typical embodiment, upon the saturated suction temperature falling below the first pre-determined minimum threshold temperature value of, for example, 32° F. for a certain period of time, the controller 150 modifies operation of the compressor 140 to mitigate the risk of ice or frost buildup. In embodiments, where the compressor 140 is a variable-speed compressor, the modification may include adjusting the speed of the compressor 140 to a value between a maximum-rated speed and a minimum-rated speed. In embodiments where the compressor 140 is a fixed-speed compressor, the modification may include cycling the compressor 140 between an activated state and a deactivated state. Adjusting the speed of the compressor 140 impacts the saturated suction temperature such that the saturated suction temperature can be lowered by either deactivating the compressor 140 or reducing the speed of the compressor 140.

Figure 3:
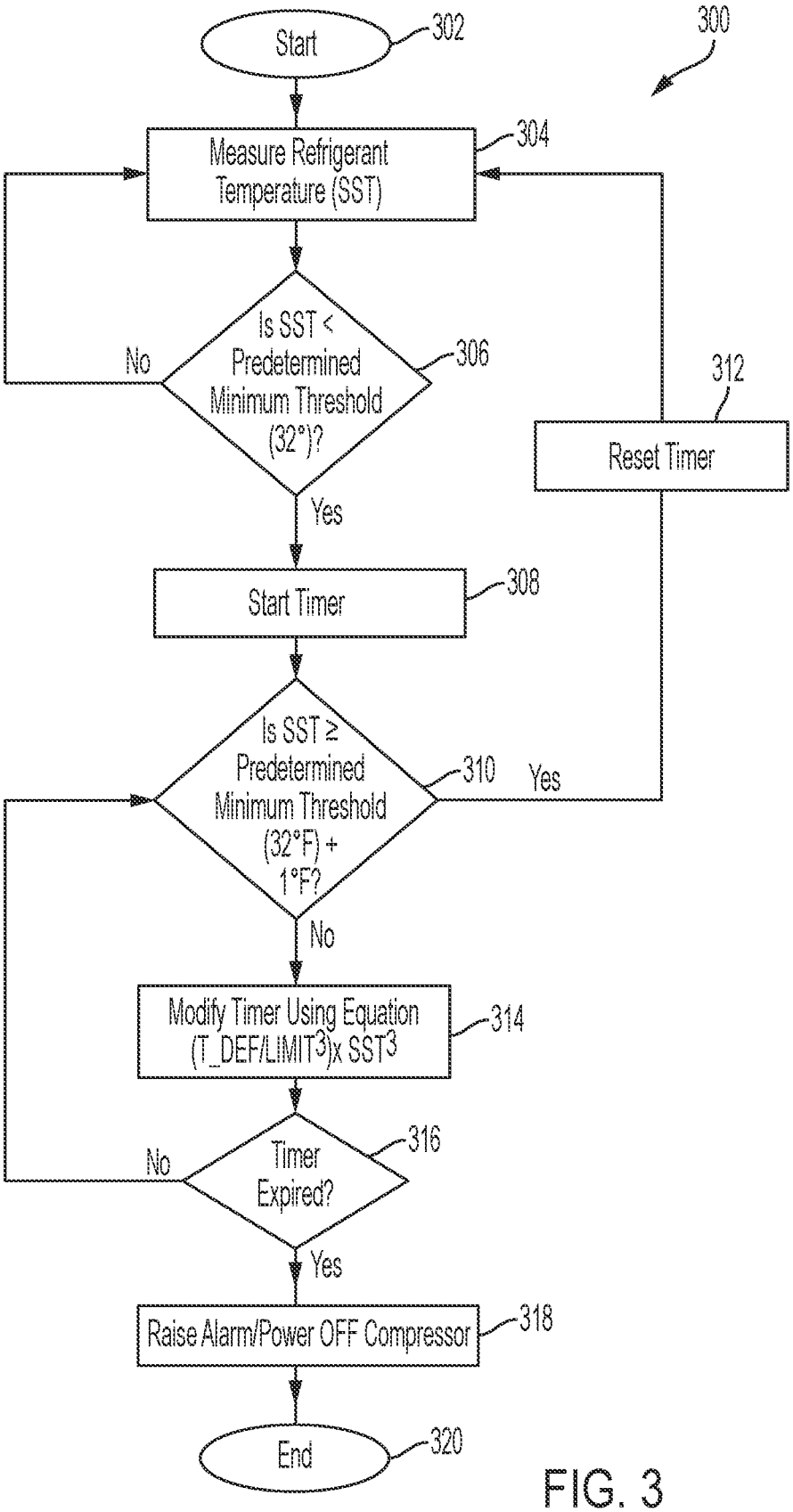
FIG. 3 is a flow diagram illustrating a process for modifying operation of a compressor upon detecting a freeze event.

FIG. 3 is a flow diagram illustrating a process 300 for modifying operation of a compressor upon detecting a freeze event. For illustrative purposes, FIG. 3 will be described herein relative to FIG. 2. The process 300 begins at step 302. At step 304, refrigerant temperature is measured utilizing the temperature sensor 224. According to an exemplary embodiment, the temperature sensor 224 is disposed proximate the distributor 203 on the evaporator circuit line 226. In various embodiments, the temperature sensor 224 may be, for example, a thermocouple, a thermometer, a thermostat, or any other appropriate temperature sensor. The temperature sensor 224 is electrically coupled to the HVAC controller 150 and measures the refrigerant temperature prior to the refrigerant entering the evaporator coil 130 (also known as the "saturated suction temperature"). In other embodiments, however, the temperature sensor 224 may be disposed at various locations within the HVAC system 200 such as, for example, on an exterior surface of the evaporator coil 130 (illustrated by dashed circle 224A) thereby using the evaporator coil 130 surface temperature as a proxy measurement for the saturated suction temperature. In a typical embodiment, the HVAC controller 150 receives an actual temperature value reflective of the measured saturated suction temperature by the temperature sensor 224.

At step 306, the HVAC controller 150 determines if the saturated suction temperature is below the first pre-determined minimum threshold temperature value. In a typical embodiment, the first pre-determined minimum threshold temperature value may be, for example, 32° F. If, at step 306, the HVAC controller 150 determines that the saturated suction temperature is above the first pre-determined minimum threshold temperature value of, for example, 32° F., the process 300 returns to step 304. However, if, at step 306, the HVAC controller 150 determines that the saturated suction temperature is below the first pre-determined minimum threshold temperature value of, for example, 32° F., the process 300 proceeds to step 308. At step 308, a timer is initiated for a pre-determined time interval. In a typical embodiment, the pre-determined time interval may be, for example, 180 seconds. From step 308, the process 300 proceeds to step 310.

At step 310, the HVAC controller 150 determines if the saturated suction temperature is greater than or equal to a second pre-determined minimum threshold temperature value. In a typical embodiment, the second pre-determined minimum threshold temperature value may be, for example, 32° F. plus 1° F. (e.g., 33° F.) to account for temperature variations. If, at step 310, the HVAC controller 150 determines that the saturated suction temperature is at or above the second pre-determined minimum threshold temperature value of, for example, 33° F., the process 300 proceeds to step 312. At step 312, the controller 150 resets the timer. From step 312, the process 300 proceeds to step 304. However, if, at step 310, the HVAC controller 150 determines that the saturated suction temperature is below the second pre-determined minimum threshold temperature value of, for example, 33° F., the process 300 proceeds to step 314. In real solutions, a rate at which the saturated suction temperature drops below a pre-determined minimum threshold temperature value and an extent to which the saturated suction temperature drops below the pre-determined minimum threshold temperature value has great importance. Exemplary embodiments take into account the rate and the extent to which the saturated suction temperature drops below the pre-determined minimum threshold temperature value to modify operation of the compressor 140 in an effort to mitigate the risk of ice or frost buildup. As such, the timer is initiated to operate for a modified time interval. At step 314, the modified time interval is calculated using the equation listed below:

$$\text{MODIFIED TIME INTERVAL}=(T_\text{DEF}/\text{LIMIT}^3)*\text{SST}^3 \text{ where}$$

T_DEF=180 seconds;

LIMIT=32° F.; and

SST is the saturated suction temperature.

From step 314, the process 300 proceeds to step 316. At step 316, the HVAC controller 150 determines if the timer operating for the modified time interval (step 314) has expired. If, at step 316, the HVAC controller 150 determines that the timer operating for the modified time interval (step 314) has not expired, the process 300 returns to step 310. However, if, at step 316, the HVAC controller 150 determines that the timer operating for the modified time interval (step 314) has expired, the process 300 proceeds to step 318. At step 318, the controller 150 raises an alarm and modifies operation of the compressor 140 to mitigate the risk of ice or frost buildup. In embodiments, where the compressor 140 is a variable-speed compressor, the modification may include adjusting the speed of the compressor 140 to a value between a maximum-rated speed and a minimum-rated speed. In embodiments where the compressor 140 is a fixed-speed compressor, the modification may include cycling the compressor 140 between an activated state and a deactivated state. Adjusting the speed of the compressor 140 impacts the saturated suction temperature such that the saturated suction temperature can be lowered by either deactivating the compressor 140 or reducing speed of the compressor 140. From step 318, the process 300 ends at step 320.

For purposes of this patent application, the term computer-readable storage medium encompasses one or more tangible computer-readable storage media possessing structures. As an example and not by way of limitation, a computer-readable storage medium may include a semiconductor-based or other integrated circuit (IC) (such as, for example, a field-programmable gate array (FPGA) or an application-specific IC (ASIC)), a hard disk, an HDD, a hybrid hard drive (HHD), an optical disc, an optical disc drive (ODD), a magneto-optical disc, a magneto-optical drive, a floppy disk, a floppy disk drive (FDD), magnetic tape, a holographic storage medium, a solid-state drive (SSD), a RAM-drive, a SECURE DIGITAL card, a SECURE DIGITAL drive, a flash memory card, a flash memory drive, or any other suitable tangible computer-readable storage medium or a combination of two or more of these, where appropriate.

Particular embodiments may include one or more computer-readable storage media implementing any suitable storage. In particular embodiments, a computer-readable storage medium implements one or more portions of the processor 320, one or more portions of the system memory 330, or a combination of these, where appropriate. In particular embodiments, a computer-readable storage medium implements RAM or ROM. In particular embodiments, a computer-readable storage medium implements volatile or persistent memory. In particular embodiments, one or more computer-readable storage media embody encoded software.

In this patent application, reference to encoded software may encompass one or more applications, bytecode, one or more computer programs, one or more executables, one or more instructions, logic, machine code, one or more scripts, or source code, and vice versa, where appropriate, that have been stored or encoded in a computer-readable storage medium. In particular embodiments, encoded software includes one or more application programming interfaces (APIs) stored or encoded in a computer-readable storage medium. Particular embodiments may use any suitable encoded software written or otherwise expressed in any suitable programming language or combination of programming languages stored or encoded in any suitable type or number of computer-readable storage media. In particular embodiments, encoded software may be expressed as source code or object code. In particular embodiments, encoded software is expressed in a higher-level programming language, such as, for example, C, Python, Java, or a suitable extension thereof. In particular embodiments, encoded software is expressed in a lower-level programming language, such as assembly language (or machine code). In particular embodiments, encoded software is expressed in JAVA. In particular embodiments, encoded software is expressed in Hyper Text Markup Language (HTML), Extensible Markup Language (XML), or other suitable markup language.

Depending on the embodiment, certain acts, events, or functions of any of the algorithms described herein can be performed in a different sequence, can be added, merged, or left out altogether (e.g., not all described acts or events are necessary for the practice of the algorithms). Moreover, in certain embodiments, acts or events can be performed concurrently, e.g., through multi-threaded processing, interrupt processing, or multiple processors or processor cores or on other parallel architectures, rather than sequentially. Although certain computer-implemented tasks are described as being performed by a particular entity, other embodiments are possible in which these tasks are performed by a different entity.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, the processes described herein can be embodied within a form that does not provide all of the features and benefits set forth herein, as some features can be used or practiced separately from others. The scope of protection is defined by the appended claims rather than by the foregoing description. All changes which come within the meaning and range of equivalency of the claims are to be embraced within their scope.

What is claimed is:

1. A method of mitigating a freeze event in a heating, ventilation, and air conditioning (HVAC) system, the method comprising:

measuring, using at least one temperature sensor, a saturated suction temperature;

receiving, by a controller, actual temperature value reflective of the measured saturated suction temperature;

determining, using the controller, whether the actual temperature value is less than a first pre-determined minimum threshold temperature value;

responsive to a determination that the actual temperature value is less than the first pre-determined minimum threshold temperature value, initiating, by the controller, a timer to operate for a pre-determined time interval;

determining, using the controller, whether the actual temperature value is less than a second pre-determined minimum threshold temperature value;

responsive to a determination that the actual temperature value is equal to or above the second pre-determined minimum threshold temperature value, resetting, by the controller, the timer;

responsive to a determination that the actual temperature value is less the second pre-determined minimum threshold temperature value, initiating, by the controller, the timer to operate for a modified time interval;

determining, using the controller, whether the timer operating for the modified time interval has expired; and responsive to a determination that the timer operating for the modified time interval has expired, modifying, using the controller, operation of a compressor.

2. The method of claim 1, wherein the saturated suction temperature comprises a temperature of refrigerant within an evaporator.

3. The method of claim 1, wherein:

the at least one temperature sensor comprises at least one of a thermocouple, a thermometer, and a thermostat.

4. The method of claim 1, wherein the at least one temperature sensor is disposed on an exterior surface of an evaporator coil thereby using a surface temperature of the evaporator coil as a proxy measurement for the saturated suction temperature.

5. The method of claim 1, wherein the first pre-determined minimum threshold temperature value comprises 32° F.

6. The method of claim 1, wherein the second pre-determined minimum threshold temperature value comprises 33° F.

7. The method of claim 1, wherein the pre-determined time interval comprises 180 seconds.

8. The method of claim 1, wherein the modified time interval is calculated using the equation:

$$\text{MODIFIED TIME INTERVAL}=(T_\text{DEF}/\text{LIMIT}^3)*\text{SST}^3 \text{ where}$$

T_DEF=180 seconds;

LIMIT=32° F.; and

SST is the saturated suction temperature.

9. The method of claim 1, wherein the modifying comprises adjusting a speed of the compressor to a value between a maximum-rated speed and a minimum-rated speed.

10. The method of claim 1, wherein the modifying comprises cycling a compressor between an activated state and a deactivated state.

11. The method of claim 1, wherein the freeze event comprises ice buildup on an evaporator of the HVAC system.

12. The method of claim 1, comprising, responsive to a determination that the actual temperature value is greater than the first pre-determined minimum threshold temperature value, repeating the measuring step.

13. The method of claim 1, comprising, responsive to a determination that the timer operating for the modified time interval has not expired, repeating the step of determining whether the actual temperature value is less than the second pre-determined minimum threshold temperature value.

14. A heating, ventilation, and air-conditioning (HVAC) system comprising:

at least one temperature sensor associated with at least one component of the HVAC system;

a controller configured to communicate with the at least one temperature sensor;

wherein the controller is configured to:

receive an actual temperature value reflective of a saturated suction temperature measured by the at least one temperature sensor;

determine whether the actual temperature value is less than a first pre-determined minimum threshold temperature value;

responsive to a determination that the actual temperature value is less than the first pre-determined minimum threshold temperature value, initiate a timer to operate for a pre-determined time interval;

determine whether the actual temperature value is less than a second pre-determined minimum threshold temperature value;

responsive to a determination that the actual temperature value is equal to or above the second pre-determined minimum threshold temperature value, reset the timer;

responsive to a determination that the actual temperature value is less the second pre-determined minimum threshold temperature value, initiate the timer to operate for a modified time interval;

determine whether the timer operating for the modified time interval has expired; and responsive to a determination that the timer operating for the modified time interval has expired, modify operation of a compressor.

15. The HVAC system of claim 14, wherein the modified operation of the compressor causes the controller to:

adjust a speed of the compressor to a value between a maximum-rated speed and a minimum-rated speed; and cycle the compressor between an activated state and a deactivated state.

16. The HVAC system of claim 14, wherein:

the first pre-determined minimum threshold temperature value comprises 32° F.; and the second pre-determined minimum threshold temperature value comprises 33° F.

17. The HVAC system of claim 14, wherein the pre-determined time interval comprises 180 seconds.

18. The HVAC system of claim 14, wherein the modified time interval is calculated using the equation:

$$\text{MODIFIED TIME INTERVAL}=(T_\text{DEF}/\text{LIMIT}^3)*\text{SST}^3 \text{ where}$$

T_DEF=180 seconds;

LIMIT=32° F.; and

SST is the saturated suction temperature.

19. A method of mitigating a freeze event in a heating, ventilation, and air conditioning (HVAC) system, the method comprising:

measuring, using at least one temperature sensor, a saturated suction temperature;

receiving, by a controller, actual temperature value reflective of the measured saturated suction temperature;

determining, using the controller, whether the actual temperature value is less than a first pre-determined minimum threshold temperature value;

responsive to a determination that the actual temperature value is less than the first pre-determined minimum threshold temperature value, initiating, by the controller, a timer to operate for a pre-determined time interval;

determining, using the controller, whether the actual temperature value is less than a second pre-determined minimum threshold temperature value;

responsive to a determination that the actual temperature value is equal to or above the second pre-determined minimum threshold temperature value, resetting, by the controller, the timer;

responsive to a determination that the actual temperature value is less the second pre-determined minimum threshold temperature value, initiating, by the controller, the timer to operate for a modified time interval;

determining, using the controller, whether the timer operating for the modified time interval has expired; and responsive to a determination that the timer operating for the modified time interval has expired, cycling a compressor from an activated state to a deactivated state.

* * * * *